US006560830B1

(12) United States Patent
Chi

(10) Patent No.: US 6,560,830 B1
(45) Date of Patent: May 13, 2003

(54) STRUCTURE OF A PLUG-IN FASTENING DEVICE

(76) Inventor: Chen-Lung Chi, PO Box 82-144, Taipei (TW)

( * ) Notice: Subject to any disclaimer, the term of this patent is extended or adjusted under 35 U.S.C. 154(b) by 0 days.

(21) Appl. No.: 10/119,733

(22) Filed: Apr. 11, 2002

(51) Int. Cl.[7] ..... A44B 11/25

(52) U.S. Cl. ..... 24/653; 24/616; 24/625; 24/633; 24/639; 24/642

(58) Field of Search ..... 24/653, 639, 642, 24/615, 616, 625, 633

(56) References Cited

U.S. PATENT DOCUMENTS 4,150,464 A * 4/1979 Tracy ..... 24/653
5,170,539 A * 12/1992 Lundstedt et al. ..... 24/625
5,311,649 A * 5/1994 Suh ..... 24/625
5,383,257 A * 1/1995 Krauss ..... 24/616
5,419,020 A * 5/1995 Murai ..... 24/625

* cited by examiner

*Primary Examiner*—Victor Sakran
(74) *Attorney, Agent, or Firm*—Leong C. Lei

(57) ABSTRACT

An improved structure of a plug-in fastening device is disclosed. An improved structure of a plug-in fastening device having a female fastener and a male fastener, characterized in that the two sides of the housing of the female fastener are provided with resilient legs and the interior of the housing is provided with a positioning sliding block and a fastening rod, by means of the top urging and pressing of a compression spring, via the pushing of the controlling button positioned at the housing of the female fastener, the protruded block of the fastening rod contacts with a positioning sliding block zigzag recess and a slot, thereby the dislocation of the fastening device due to external force is prevented.

1 Claim, 4 Drawing Sheets

STRUCTURE OF A PLUG-IN FASTENING DEVICE

BACKGROUND OF THE INVENTION (a) Field of the Invention

The present invention relates to an improved structure of a plug-in fastening device, and in particular, to a fastening device having a dislocation prevention device for use in various types of bags and suitcases.

(b) Description of the Prior Art

Generally, bags for carrying articles are provided with straps or ring members facilitating carrying with hands. These straps with conventional fasteners used to lock bags or ring members are normally detachable or separable as the bags or the ring members are provided with a male and a female fastener. An example of the conventional fastener is shown in FIG. 1, wherein one end of the female fastener 20 housing is provided with through hole 21 for riveting and one lateral side of the fastener is a hollow housing to receive the male fastener 10. The inner recessed region of the female fastener is provided with recessed aperture 22 and the outer edge is extended with two resilient legs 25 to the housing. A protruded fixing board 26 is provided to the board of the resilient legs 25 at an appropriate position, and the male fastener is provided with an engaging member 11 which can be compressed and extended, and an urging rod section 12 and an external end for a strap to surround to the rod section. The conventional fasteners provide a quick plug-in locking and unfastening. However, when a bag mounted with such conventional fastener contains too much articles that the bag bodies expand outwardly, there is not securing feature and the fastener may be dislocated. As a result it is an object of the present invention to provide an improved structure of a plug-in fastener, which mitigates the above drawback.

SUMMARY OF THE INVENTION

Accordingly, it is an object of the present invention to provide an improved structure of a plug-in fastening device, wherein the hollow space of the female fastener is provided with a positioning sliding-block, and fastening rod, and with a compression spring, and the pushing of the control button at the female fastener housing, the male fastener is engaged with the hollow space of the female fastener, and by means of the blockage of the sliding block, the male fastener achieves the objective of dislocation prevention, and by triggering the fastening rod, the male fastener can be dismantled.

Yet another object of the present invention is to provide an improved structure of a plug-in fastening device having a female fastener and a male fastener, characterized in that the two sides of the housing of the female fastener are provided with resilient legs and the interior of the housing is provided with a positioning sliding block and a fastening rod, by means of the top urging and pressing of a compression spring, via the pushing of the controlling button positioned at the housing of the female fastener, the protruded block of the fastening rod contacts with a positioning sliding block zigzag recess and a slot, thereby the dislocation of the fastening device due to external force is prevented.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PRESENT INVENTION

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
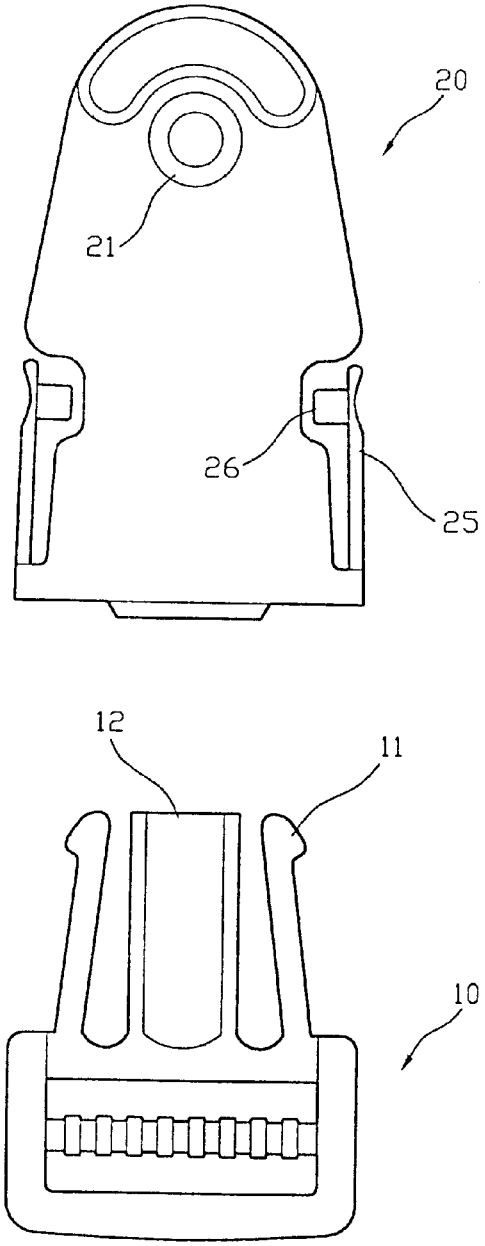
PRIOR ART FIG. 1
FIG. 1 is a schematic plan view of a conventional plug-in fastening device.
Figure 2:
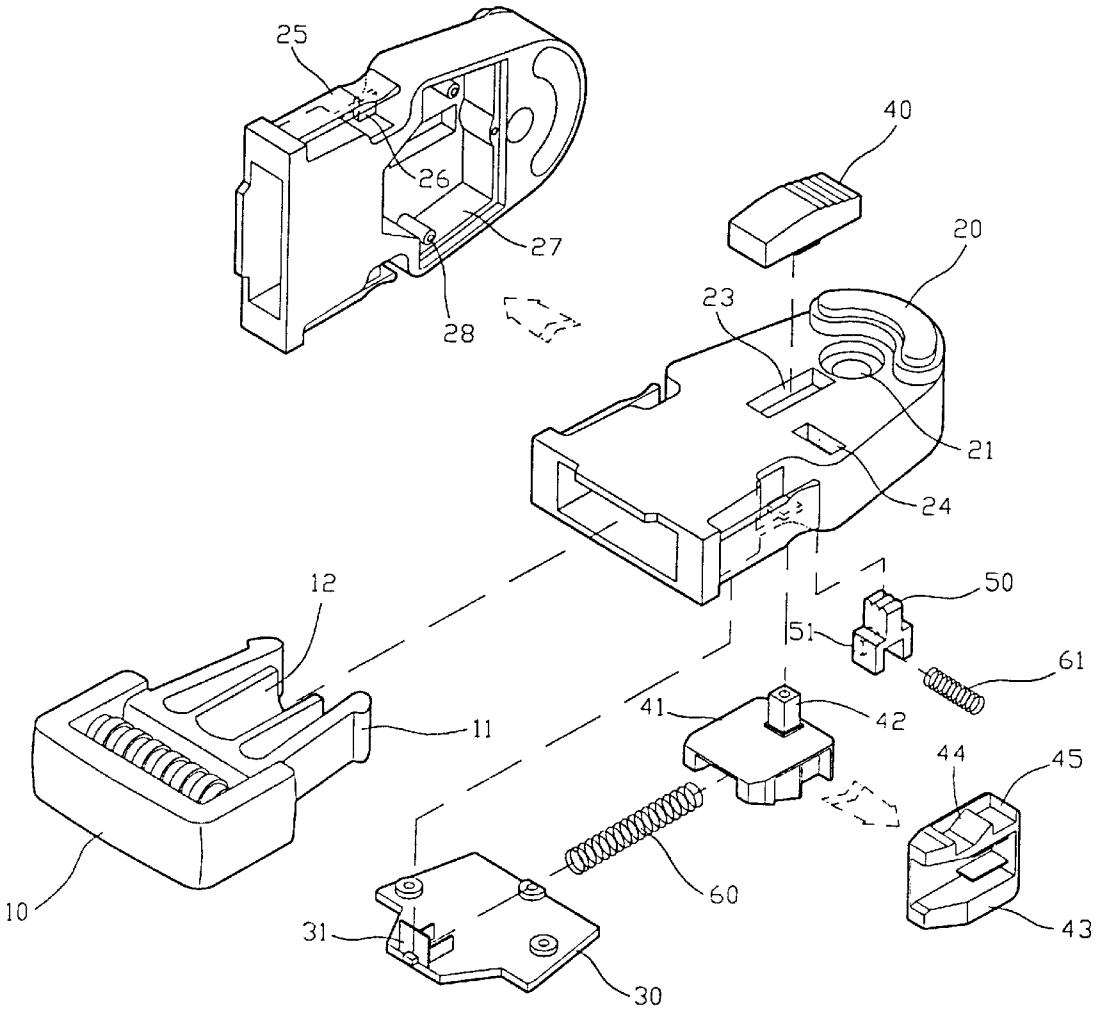
FIG. 2 is a perspective view of the plug-in fastening device in accordance with the present invention.

Referring to FIG. 2, there is shown an improved structure of a plug-in fastening device comprising a male fastener 10 and a female fastener 20, wherein the female fastener 10 is provided with a through hole 21 at the edge end of the housing thereof for the riveting onto bags or suit case. The interior of the female fastener housing is hollow. At proximity to the through hole 21, two elongated slots 23, 24 are provided. One of the slots 23, 24 is used for the mounting of a control button 40, and the other slots 23, 24 are used for mounting with a fastening rod 50. The bottom section of the housing is provided with a recessed hole 27 and a plurality of protruded rods 28 for the locking with a bottom cover 30. One side of the bottom cover 30 is provided with a blocking board 31, and the arch-shaped section at the center of the female fastener housing is provided with two recessed apertures 22, and the sides of the arch-shaped section is extended to form a resilient leg 25. The inner sideboard body of the resilient leg 25 is protruded to form a fixing board 26 for mounting with a positioning sliding block 41 at the female fastener housing. The positioning sliding block is a square body having an upper protruded element 42 for locking with the control button positioned at the external of the female fastener housing. The bottom section is provided with two sliding rails at the lateral side thereof and having an inner recessed region. One side of the recessed region is provided with a zigzag recesses 44 and a recessed slot 45. A compression spring 60 is provided between the blocking board and the inner recessed region, and one side of the slot is mounted with a fastening rod. The recessed hole at the fastening rod is used for mounting with the compression spring 61. The protruded block at the front section is used for the positioning of the positioning sliding block recessed slot.

The two sides at the front end of the male fastener 10 are provided with an engaging section 11 which can be compressed and extended. The engaging section 11 can be secured at the recessed apertures 22 at the arch-shaped region of the female fastener 20. The male fastener is characterized in that the urging rod section 12 at the center of the engaging section is a shorter element allowing the positioning sliding block 41 of the male fastener to be urged at the urging rod section 12.

Figure 4:
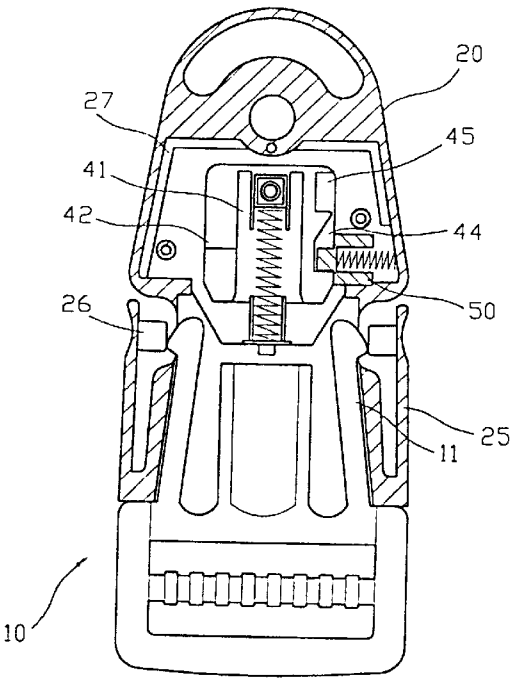
FIG. 4 is a sectional view of the plug-in fastening device in accordance with the present invention.
Figure 3:
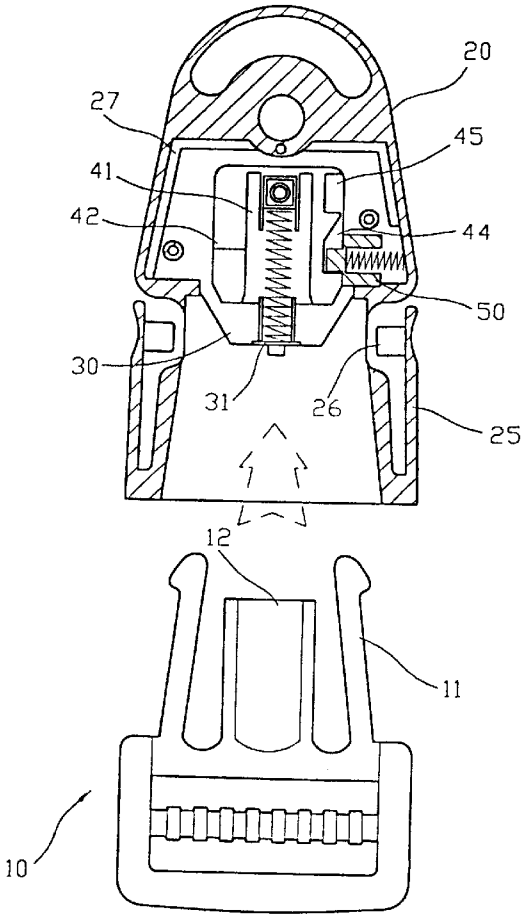
FIG. 3 is an exploded sectional view of the plug-in fastening device of the present invention.
Figure 6:
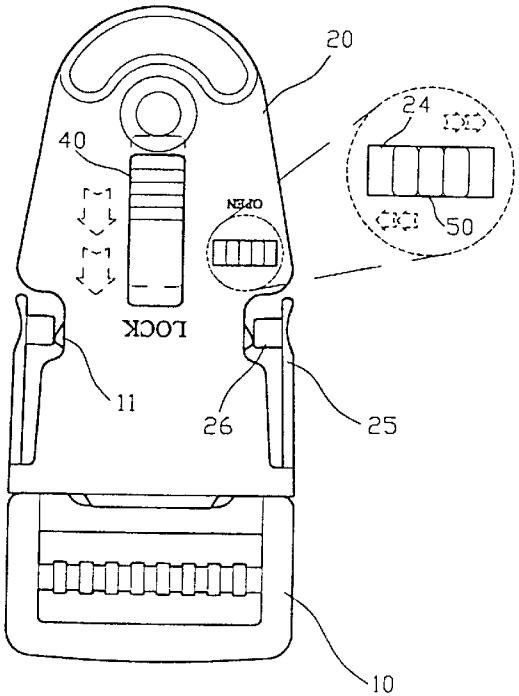
FIG. 6 shows the sectional view of the fastening rod of the present invention.
Figure 5:
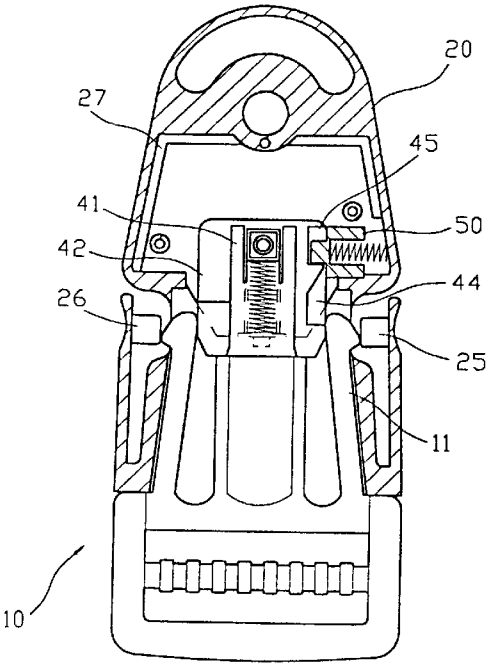
FIG. 5 shows the sectional view of the positioning sliding block fastener of the present invention.

Referring to FIGS. 3 and 4, the engaging section 11 of the male fastener 10 is inserted into the female fastener, at this instance; the arch-shaped region is engaged with the recessed aperture 22. In the present invention, the female fastener 20 housing is incorporated with the positioning sliding block 41, the fastening rod 50 and the compression springs 60, 61. Referring to FIGS. 5 and 6, the control button 40 at the female fastener is pushed and the sliding block is moved forward. Before the sliding block is operated to move, the protruded block 51 urges the zigzag recess 44 and by means of the control button the protruded block at the fastening rod at the zigzag recess is moved to the recessed slot 45 for the sliding block to be positioned. At this instance, the fastening rod will move to the right with equal distance and by means of positioning of the control button, the fastening rod will also move to the left side of the recess for positioning and urge the urging rod section 12 of the male fastener. After mounting, the engaging section 11 is blocked by the sliding block at the sides, and the securing board 26 cannot be compressed into the inner side. Thus, the male fastener after mounting will not be dislocated and when such fasteners are disposed to bags or suitcases, the bag or the suitcase can hold more articles without being opened as a result of the expansion of the contained items.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An improved structure of a plug-in fastening device having a female fastener comprising a housing having two sides and a male fastener having urging rod section, characterized in that the two sides of the housing of the female fastener are provided with resilient legs and the interior of the housing is provided with a positioning sliding block having a zigzag recess and a recessed slot and a fastening rod having a protruded block, by means of the top urging and pressing of a compression spring, via the pushing of the controlling button positioned at the housing of the female fastener, the protruded block of the plug-in fastening rod contacts with a positioning sliding block zigzag recess and a slot and said positioning sliding block engaging said urging rod section to said male fastener, thereby the dislocation of the fastening device due to external force is prevented.

* * * * *